United States Patent [19]

Cook

[11] Patent Number: 4,675,077

[45] Date of Patent: Jun. 23, 1987

[54] ADJUSTABLE MEANS FOR PROFILE CORRECTION FOR A HEADBOX SLICE

[75] Inventor: William G. Cook, Glens Falls, N.Y.

[73] Assignee: Sandy Hill Corporation, Hudson Falls, N.Y.

[21] Appl. No.: 876,756

[22] Filed: Jun. 20, 1986

[51] Int. Cl.[4] ..... D21F 1/02; D21F 1/06

[52] U.S. Cl. ..... 162/344; 162/347

[58] Field of Search ..... 162/344, 345, 346, 347, 162/259; 425/381, 466

[56] References Cited

U.S. PATENT DOCUMENTS

| | | | |
|---|---|---|---|
| 3,769,154 | 10/1973 | Wolf | 162/347 |
| 3,977,938 | 8/1976 | Descary et al. | 162/347 |
| 4,050,499 | 9/1977 | Luey et al. | 162/347 |
| 4,373,993 | 2/1983 | Fujiwara | 162/344 |
| 4,517,056 | 5/1985 | Roerig et al. | 162/344 |

*Primary Examiner*—Kenneth M. Schor
*Assistant Examiner*—K. M. Hastings
*Attorney, Agent, or Firm*—Ross, Ross & Flavin

[57] ABSTRACT

At the slice region of a headbox of a papermaking machine, an upper lip is extended across the machine width above the area where the stock suspension is charged onto the forming wire. To the lip is secured a profiling member with a portion thereof being extendable into the throat of the stock passage. The member has spaced upstanding arms. Inwardly-facing coaxially-aligned bolting extends through each arm and the pair thereof support a rectangular open frame. A load is disposed within the frame so as to be spaced from any side thereof, being supported on each side by the bolting. A self-contained force couple may be generated against the load in the form of equal forces in opposite directions.

2 Claims, 1 Drawing Figure

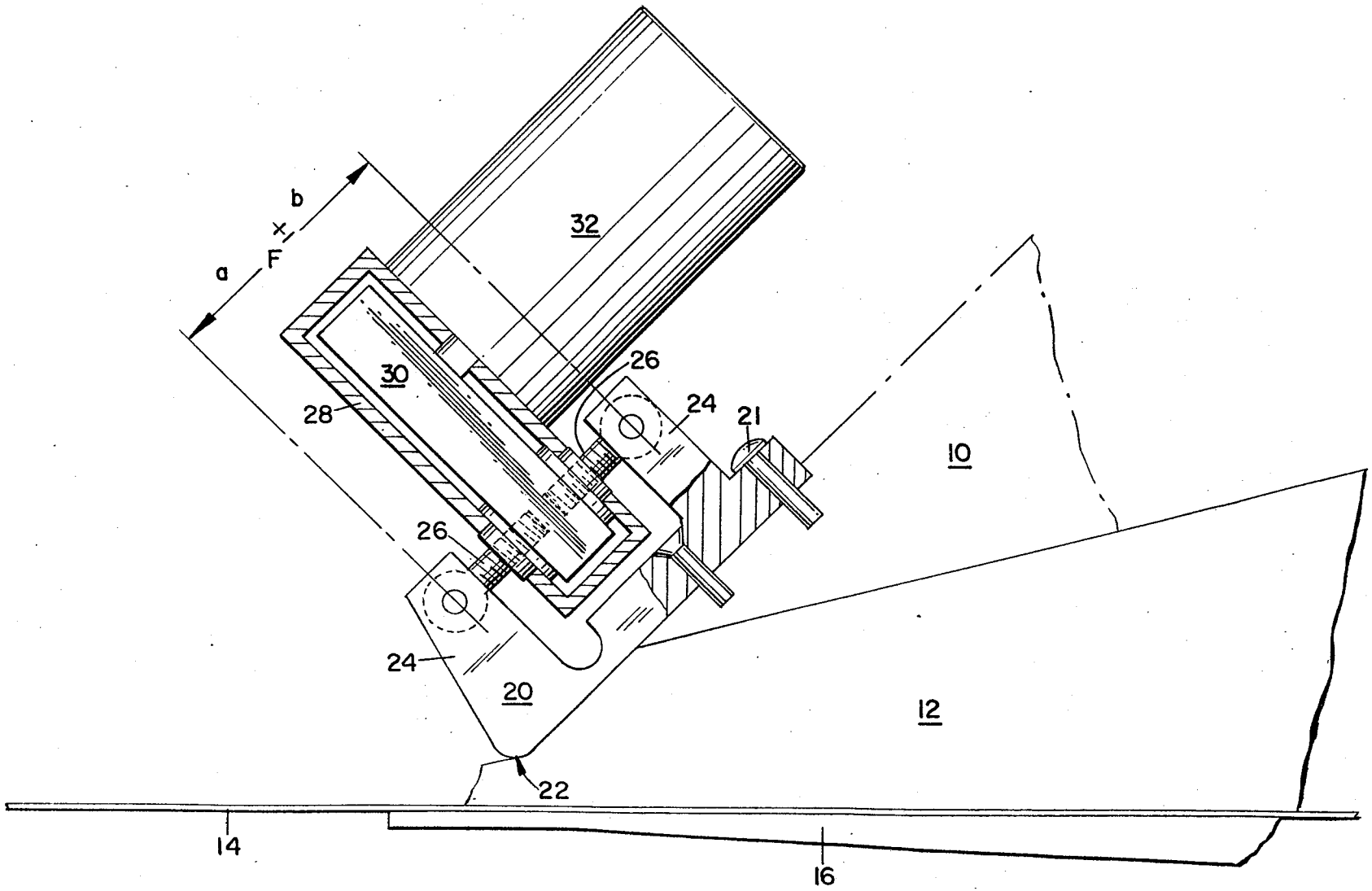
10
12
16
14
21
24
26
32
22
20
30
28
b
x
F
a

ADJUSTABLE MEANS FOR PROFILE CORRECTION FOR A HEADBOX SLICE

BACKGROUND OF THE INVENTION

1. Field of the Invention:

In the manufacture of most paper grades, a desideratum is to provide a mechanism for adjusting the discharge of the fluent system or stock onto the forming wire for controlling profile.

The need for an adequate mechanism is dictated by the difficulties inherent in the building of a headbox capable of providing a so-called perfect jet across the machine width, i.e. a jet which discharges free of variations in terms of both quantity and speed across the machine. The width measurement, incidentally, grows with each successive generation of sophisticated papermaking machinery, widths of up to 400″ now being commonplace.

The front wall beam of a headbox defines the component which carries the upper lip structure constituting the upper edge of the slice. Reformation of such a front wall beam or deflection thereof will influence the geometry of the lip slice and therefore the transverse profile or cross section of the stream of pulp stock flowing through the slice onto the wire.

2. Description of the Prior Art

Various earlier patents have been known to approach the broad problem from different angles.

U.S. Pat. Nos. 3,769,154 to Wolf, 3,976,539 to Kirjavainen, and 4,008,123 also to Kirjavainen, each relate to the matter of compensating for inherent deflections in the slice area, these deflections being resultant from the very weight or stiffness of the slice structure, or the operating pressure under which the headbox is operative.

In times past, manual profiling has been achieved by the mechanical deformation of the slice lip, that is the upper portion or roof of the discharge orifice, through the use of spaced jacks positioned on and between the slice lip and some suitably near stationary surface. Actuation of the jacks was sufficient to deform the slice lip.

As computerized profile controlling became known, different mechanisms were incorporated into the jacking system, as witness U.S. Pat. Nos. 4,406,740 to Brieu and 4,505,779 to Boissevain.

The computer controlled systems have brought with themselves a problem only partly remedied and not totally eliminated thereby. That problem relates to the influence which one adjustment mechanism tends to exert on adjacent mechanisms. That is to say, when one jack is adjusted or corrected, neighboring jacks are affected. A simple correction in one jack compounds itself in a correction or recorrection of perhaps two or three or four or more other jacks, the damaging results being obvious.

SUMMARY OF THE INVENTION

The objectionable phenomenon is due to the force couple involved when the jack is connected between the slice lip (sometimes called the profile bar) and the cross machine beam or other fixed appurtenance, the couple being defined as a system of two parallel forces of equal magnitude and opposite sense when the total force of the couple is zero with the total moment of the couple being identical about any point.

In the instance of a force couple, the force at the slice lip will have an equal opposite force at the beam or other stationary component and the forces will be such as to deflect the beam or the lip or both for the reason that these members cannot be made of infinite stiffness.

As one adjustment is made, the beam, for example, will deflect from an earlier position, obviously disrupting the adjustment of one or more of the previously set jacks.

This invention eliminates the force couple between the slice lip and fixed beam, the force couple now being confined to the slice area, a feature emanating from the theory that with a force couple being so self-contained the slice lip cannot contribute to any deflection in the cross beam or other fixed member. Under such a restriction, the tendency resultant from a jack adjustment to influence any adjustment in any adjacent jack is minimized, if not eliminated.

BRIEF DESCRIPTION OF THE DRAWING

The FIGURE is a schematic diagram of a slice lip incorporating the invention's essentials.

DESCRIPTION OF THE PREFERRED EMBODIMENT

A headbox slice 10 in the form of the roof of a passage or nozzle 12 for the delivery of a fluent stock or slurry to the forming wire 14 at the terminus of the usual headbox apron 16 is provided at its outboard extremity with a generally U-shaped profiling nozzle 20, the lowermost extremity of which is extended into passage 12 to define a slice lip 22 which determines the thickness of the stock flowing from passage or nozzle 12 onto the forming wire. It may be adjusted at different spaced points along its length across the machine width.

Profiling nozzle 20 is fixed relative to headbox slice 10 as by bolting 21 and extends lengthwise across the machine width, being strategically fixed relatively thereto at spaced points thereacross by means of the bolting.

Spaced arms 24, 24 of profiling nozzle 20 are each provided with sets of inwardly-facing coaxially-aligned bolting 26, 26, which bolting supports a rectangularly-configured open frame 28 in the center of which frame and in spaced relation thereto a load 30 is supported by the bolting in spaced relation to the frame.

A force F may be generated manually or, as shown, by means of a servo unit 32 interconnected with load 30 disposed in spaced parallelism with bolting 26, 26 as a force couple in the force and aft directions as designated by letters a and b. The couple is formed by forces a and b, they being equal but acting in opposite directions so that the resultant equals zero. In other words, the two forces have no resultant, ergo their designation as a couple.

In this manner, the force couple will thus be seen to be restricted to the slice area per se and treated as self-contained meaning that the slice does not contribute to any deflection in any other machine component, the very desideratum of the invention.

Being so, any adjustment of the slice opening made manually or made with the aid of the servo unit will be observed to have practically no influence on the setting of the slice at any adjacent adjustment means. That is, the forces are isolated in the nozzle per se, eliminating any influence on other components of the paper machine.

Thus a state of balance exists between the forces. That is, a state of static equilibrium is attained, the term being used in its dynamical sense.

I claim:

1. In a headbox for a papermaking machine having a slice spaced upwardly of an apron and defining a slice opening therebetween through which a fluent fibrous stock is delivered from the headbox to a traveling surface of a continuously-moving looped foraminous forming member, a slice nozzle for correcting profile comprising:

a profiling nozzle stationarily secured to the slice and extendable across the machine width and having a lowermost extremity extended downwardly into the slice opening, the profiling nozzle having spaced upwardly extending arms, inwardly-facing bolting extending through each spaced arm and being coaxially-aligned as to each other, a rectangular-shaped open frame disposed inboard of the spaced arms and supported therefrom by means of the bolting extendable through two opposite sides of the frame, a load held in spaced relation to the opposite sides of the frame by means of the bolting extendable into said two opposite sides of the load, means positioned parallel to the bolting for generating a self-contained force couple upon the load in the form of equal forces in fore and aft directions, the profiling nozzle in combination with the load and means for generating the self-contained force couple being structured so that the slice does not contribute to any deflection in any other machine component.

2. In a headbox for a papermaking machine having a slice spaced upwardly of an apron and defining a slice opening therebetween through which a fluent fibrous stock is delivered from the headbox to a traveling surface of a continuously-moving looped foraminous forming member, a slice nozzle comprising:

a profiling nozzle stationarily secured to the slice and projecting downwardly into the slice opening, the profiling nozzle having spaced arms, inwardly facing bolting extending through each spaced arm being coaxially-aligned as to each other, a rectangular-shaped open frame disposed inboard of the arms and supported therefrom by means of the bolting extendable through two opposite sides of the frame, a load held in spaced relation to the opposite sides of the frame by means of the bolting extendable into the two opposite sides of the load, means located parallel to the bolting for generating a self-contained force couple upon the load in the form of equal forces in fore and aft directions, the profiling nozzle in combination with the load and means for generating the self-contained force couple being structured so that the slice does not contribute to any deflection in any other machine component.

* * * * *